United States Patent [19]

Rudy, Jr. et al.

[11] Patent Number: 4,684,187

[45] Date of Patent: Aug. 4, 1987

[54] RETENTION ARTICLE FOR ELECTRICAL CONTACTS

[75] Inventors: William J. Rudy, Jr., Annville; Thomas H. Wycheck, Harrisburg, both of Pa.

[73] Assignee: AMP Incorporated, Harrisburg, Pa.

[21] Appl. No.: 869,468

[22] Filed: May 28, 1986

Related U.S. Application Data

[63] Continuation of Ser. No. 626,002, Jun. 29, 1984, abandoned.

[51] Int. Cl.[4] ..... H01R 11/00

[52] U.S. Cl. ..... 439/600; 439/598

[58] Field of Search ..... 339/59 R, 59 M, 61 R, 339/61 M, 63 R, 63 M, 217 S

[56] References Cited

U.S. PATENT DOCUMENTS

| | | | |
|---|---|---|---|
| 2,383,926 | 8/1945 | White | 173/361 |
| 3,066,272 | 11/1962 | Quackenbush | 339/60 |
| 3,101,229 | 8/1963 | Yopp | 339/59 M |
| 3,165,369 | 1/1965 | Maston | 339/59 M |
| 3,221,292 | 11/1965 | Swanson et al. | 339/217 S |
| 3,390,376 | 6/1968 | Nava | 339/217 S |
| 3,404,364 | 10/1968 | Paullus et al. | 339/61 M |
| 3,477,061 | 11/1969 | Stephenson | 339/59 M |
| 3,638,165 | 1/1972 | Anhalt et al. | 339/59 R |
| 3,727,172 | 4/1973 | Clark | 339/59 M |
| 3,812,447 | 5/1974 | Eifler et al. | 339/59 R |
| 4,023,880 | 5/1977 | Powell | 339/59 R |
| 4,082,398 | 4/1978 | Bourdon et al. | 339/217 S |
| 4,187,272 | 2/1980 | Bourdon et al. | 264/318 |
| 4,241,967 | 12/1980 | Collins | 339/59 M |
| 4,358,179 | 11/1982 | Bourdon et al. | 339/217 S |
| 4,386,816 | 6/1983 | Frear et al. | 339/59 R |
| 4,406,507 | 9/1983 | Eifler | 339/59 R |
| 4,422,711 | 12/1983 | Wolowicz | 339/252 R |
| 4,440,463 | 4/1984 | Gliha, Jr. et al. | 339/14 R |
| 4,443,048 | 4/1984 | Moist, Jr. | 339/63 M |

FOREIGN PATENT DOCUMENTS 2073744 9/1971 France .

*Primary Examiner*—Gil Weidenfeld
*Assistant Examiner*—Paula A. Austin
*Attorney, Agent, or Firm*—Anton P. Ness

[57] ABSTRACT

A retention article for retaining closely-spaced terminals in a connector housing is formed having a stiff water-like article of thermoplastic material and elastomeric material therearound, with a plurality of holes extending therethrough. A pair of arcuate, partly converging wall sections partly surround each hole of said water-like article and extend forwardly from a planar section thereof having forward ends acting as stop surfaces to engage a stop shoulder on each terminal inserted therein. Elastomeric material forward of the planar section surrounds and abuts the outside surfaces of the wall sections, so that when a terminal is inserted into a hole of the retention article it slightly expands the stiff wall sections apart until the stop shoulder passes the forward ends, and the elastomeric material acts to urge the wall sections together against the terminal behind the stop shoulder. Elastomeric material rearward of the planar section has holes extending therethrough from the planar section to a rearward end of the retention article, and the holes preferably have a diameter slightly smaller than conductors on terminals inserted therethrough to grip the conductors. The elastomeric material permits a slender extraction tool to be inserted along a conductor, expanding the elastomeric material, and then urging the ends of wall sections and adjacent elastomeric material around the terminal to release the terminal which may then be withdrawn rearwardly along with the extraction tool from the connector. A method of molding the elastomeric material over the stiff wafer-like article is disclosed. Large retention tines on sides of the retention article secure the retention article within the housing.

42 Claims, 8 Drawing Figures

RETENTION ARTICLE FOR ELECTRICAL CONTACTS

This application is a Continuation of application Ser. No. 626,002 filed June 29, 1984, now abandoned.

FIELD OF THE INVENTION

This invention relates to the field of electrical connectors and more particularly to the retention of electrical contacts within an electrical connector.

BACKGROUND OF THE INVENTION

Various means and methods are known to retain pin and socket contact terminals within a dielectric housing of an electrical connector. One such means is disclosed in U.S. Pat. No. 4,422,711 (assigned to the assignee hereof) wherein a pin contact is secured by using cooperating stop shoulders on both the contact and the wall of the terminal cavity of the housing, and further secured by using potting material. U.S. Pat. No. 4,585,294 discloses the terminal having a rearwardly-facing circumferential stop shoulder, and a spring clip held in the cavity of the housing has forwardly-facing lances which engage the stop shoulder to prevent rearward movement of the terminal. But such methods are inadequate in small connectors having very closely spaced terminals, especially where it is desired to provide for replaceability of the terminals.

U.S. Pat. No, 2,383,926 teaches the use of a gland of elastomeric material having holes therein for insertion of terminals therethrough which, when a surrounding housing is tightened against it, clamps against the terminals locking them in place and also forming a tight seal around them.

At such close spacing as where the centerlines of terminals are 0.050 inches apart and where each terminal is about 0.018 inches in radius (or 0.036 inches in diameter), very little distance remains between adjacent terminals, and conventional retention means such as housing cavity walls and individual metal clips (which are conductive) are unavailable. The use of potting compound alone would also be inadequate due to the need for very accurate placement and spacing of the terminals, or would involve uneconomical production cost.

SUMMARY OF THE INVENTION

A wafer-like article is formed of thermoplastic material, having holes therethrough for insertion of a plurality of contact terminals, and having rearwardly extending retention tines on sides thereof for being retained in a connector housing by stop shoulders or the like in the housing. Around each hole and extending forward from a planar section of the wafer are frustoconical resilient wall sections spaced from each other around the hole to be opposed from each other, and ends of the wall sections tend to converge such that when a contact terminal is inserted through the hole from a rearward end of the wafer it is engaged by the ends of the wall sections and it urges them apart; upon complete entry of the terminal into the wafer a rearwardly-facing circumferential stop surface of a stop shoulder of the terminal is engaged by the forward ends of the wall sections and is held against rearward movement relative to the wafer.

According to another aspect of the invention, an elastomeric material such as silicone rubber may be overmolded over the retention wafer to assist in retaining the wafer in the housing by providing spring force outwardly against the tines, to assist in retaining the terminal within the connector by providing spring force radially inwardly against the abutting wall sections to urge them more tightly around the terminal, to provide a sealing engagement by a rearward ledge against a rearward surface of the connector housing, and to assist in sealing around the insulation of the conductor to which the terminal is terminated.

The present invention allows for close spacing of the terminals such as where the centerlines of terminals are 0.050 inches apart. The elastomeric overmolding allows for removal of a terminal using an extraction tool because the elastomeric material is expandable from around a conductor to allow entry of the tool from the rear of the housing.

The present invention also allows for either preloading of terminals thereinto prior to the assembly being secured in the connector housing, or securing the overmolding/wafer assembly into the housing and subseqent loading of terminals thereinto.

The present invention has another advantage in that it is also self-retaining within a housing because of large retention tines on the sides of the retention article which engage recesses in the connector housing when fully inserted into the housing.

DETAILED DESCRIPTION OF THE PREFERRED EMBODIMENT

Figure 1:
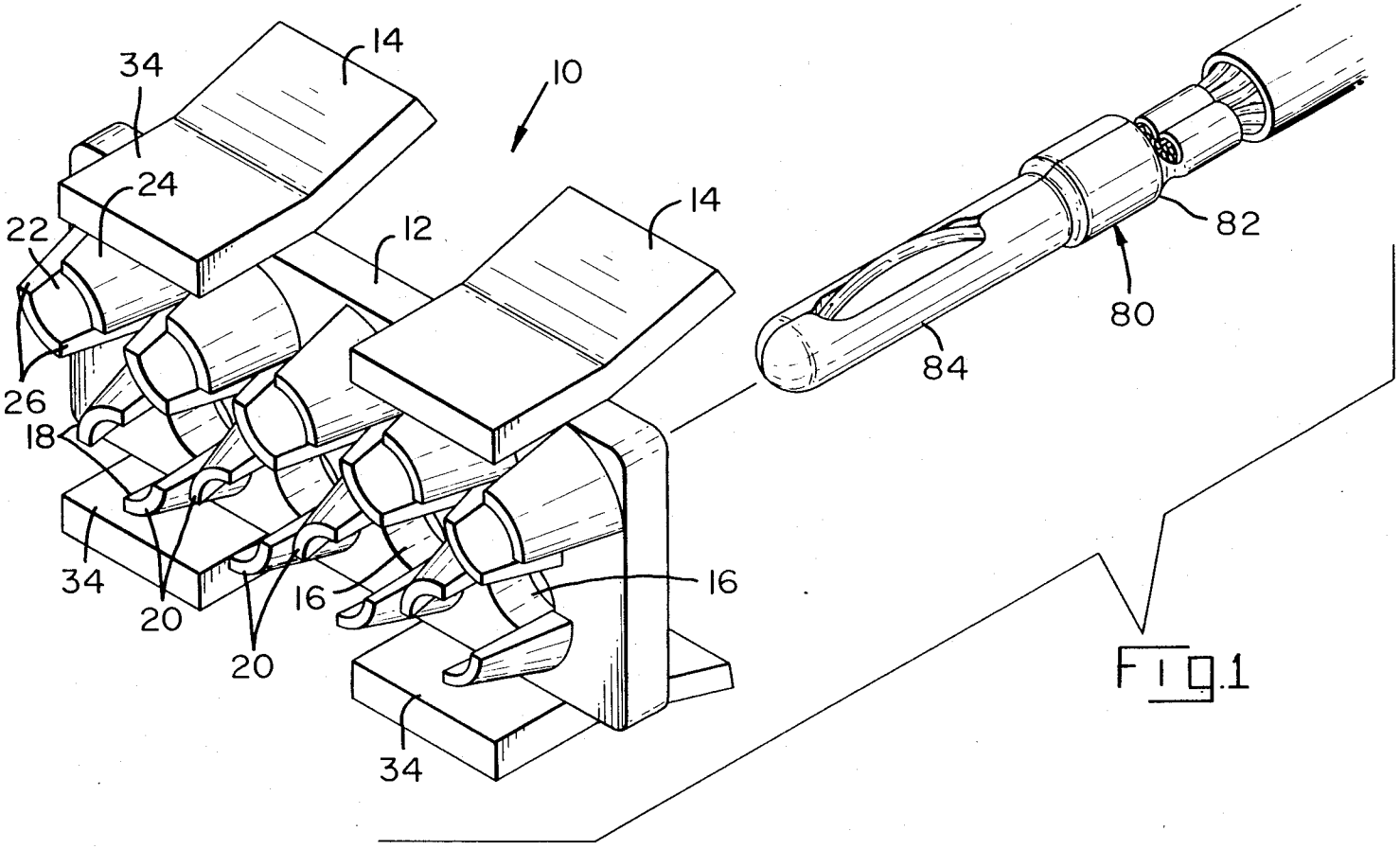
FIG. 1 shows a perspective view of the retention wafer and a terminal spaced therefrom.

A retention wafer 10 of the present invention is shown in FIG. 1, made of a stiff dielectric material and preferably made of a thermoplastic material such as ULTEM (trademark of General Electric Co.) polyetherimide resin. Wafer 10 has a planar section 12, large retention tines 14 extending rearwardly from sides of planar section 12 and angled outwardly. A plurality of holes 16 extend through planar section 12 such as in rows, and around each hole 16 are opposing wall sections 18 extending forwardly from planar section 12. Wall sections 18 are arcuate extending around the circumference of a hole 16 each for a substantial angular distance such as 60° to 120° and preferably 90°, tending to converge toward each other at their forwardly-facing forward ends 20 and form partial frustoconical shapes, the inner radius of forward ends 20 being slightly smaller than the radius of hole 16. The resilience of wall sections 18 allows for a terminal 80 being inserted through the hole 16 and having a diameter just smaller than that of hole 16, to force or urge the ends 20 of wall sections 18 to the side and continue past. When terminal 80 is completely inserted through a hole 16, ends 20 of wall sections 18 have stop surfaces which will engage a rearwardly-facing stop surface of a stop shoulder 82 of terminal 80 to secure the terminal against rearward movement of the terminal. The resilient nature of wall sections 18 will also tend to hold the terminal against lateral movement, being spring biased against the terminal. Each wall section 18 has an inside surface 22, an outside surface 24 and side surfaces 26.

Wafer 10 also preferably has forwardly extending projections 34 along the outside perimeter of planar section 12. Projections 34 are coterminous and extend slightly farther forward than ends 20 of wall sections 18 and engage a rearwardly facing stop shoulder inside the connector housing for positioning the retention article of the present invention within the housing, as is more clearly shown in FIG. 5. Alternatively, surface 64 of connector housing 60 could have rearwardly extending projections having ends which engage planar section 12 of wafer-like article 10 proximate sides thereof; or small projections from side 66 of large cavity 62 could be so located to engage planar section 12 forwardly thereof.

Figure 2:
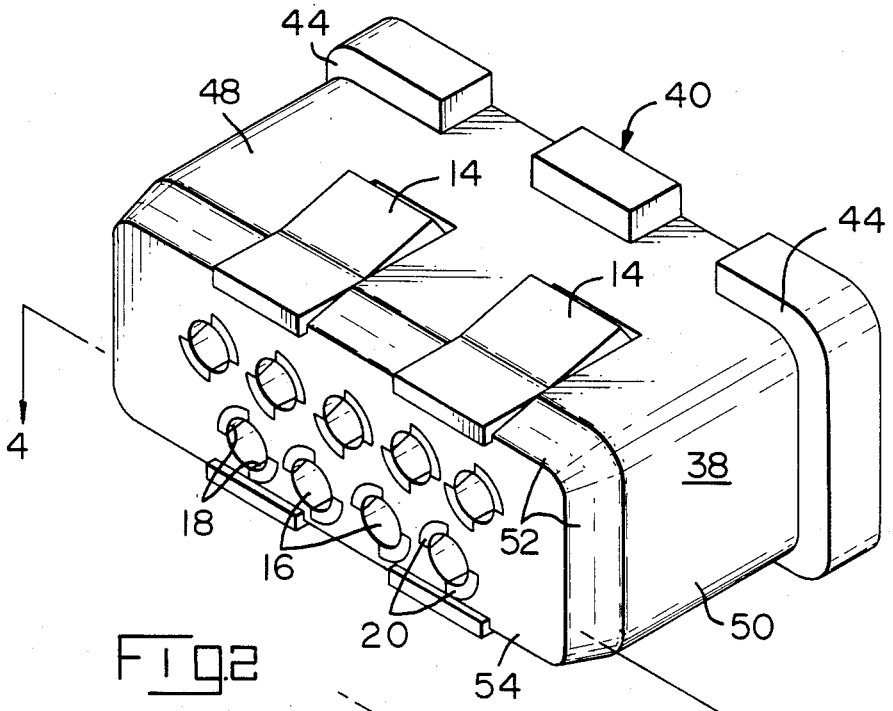
FIG. 2 shows a perspective view of the retention wafer of FIG. 1 with overmolding therearound.

FIG. 2 shows a retention assembly 40 formed by retention wafer 10 having elastomeric material 38 overmolded around it with a first portion forward of planar section 12 and a second portion rearward thereof. Large retention tines 14 of wafer 10 extend outward from assembly 40, and holes 42 (see in FIG. 4) are formed in the second portion of elastomeric material 38 such as during the overmolding process to be aligned with holes 16 of wafer 10 such that a terminal 80 may be inserted completely therethrough. Assembly 40 has a ledge 44 peripherally mostly therearound at its rearward end 46, opposing parallel sidewalls 48 and opposing parallel end walls 50 each having a slightly beveled perimeter 52 proximate forward end 54, which may be flush with coterminous ends 20 of wall sections 18 of wafer 10. Elastomeric material 38 may be silicone rubber or the like which provides spring force to tines 14 and wall sections 18 against which the elastomeric material 38 abuts, and also is expandable when urged by an extraction tool from within a hole 42.

Where centerlines of holes 16 are to be closely spaced such as at a distance of 0.050 inches therebetween, and the holes are to be aligned in rows, one spacing pattern which provides for the narrowest distance between rows alternates the holes in a diagonal W-pattern. Thus, referring now to FIG. 3, holes **16*a* and 16*b* within the same row are 0.050 inches apart at their centers, and hole 16*c* in the other row is also 0.050 inches from either 16*a* or 16*b*, even though the rows of centers are less than 0.050 inches apart. The formation and placement of wall sections 18 around holes 16 in such a hole pattern should be such that wall sections 18 do not interfere with each other and yet extend a significant angular distance around each hole 16 with as thick a base as possible. A narrow wall 28 separates any two adjacent holes 16, and wall 28 has a thickness at its narrowest point 30 (on a line between the centers of such holes) which equals the centerline separation less twice the radius of a hole 16. For example, if the radius of a hole 16 if 0.0195 inches and the centerline separation is 0.050 inches, the thickness of wall 28 at point 30 is 0.011 inches. The bases of wall sections 18 extending forward from such a point 30 have a thickness which preferably is equal to but not less than this thickness of wall 28**.

Figure 3:
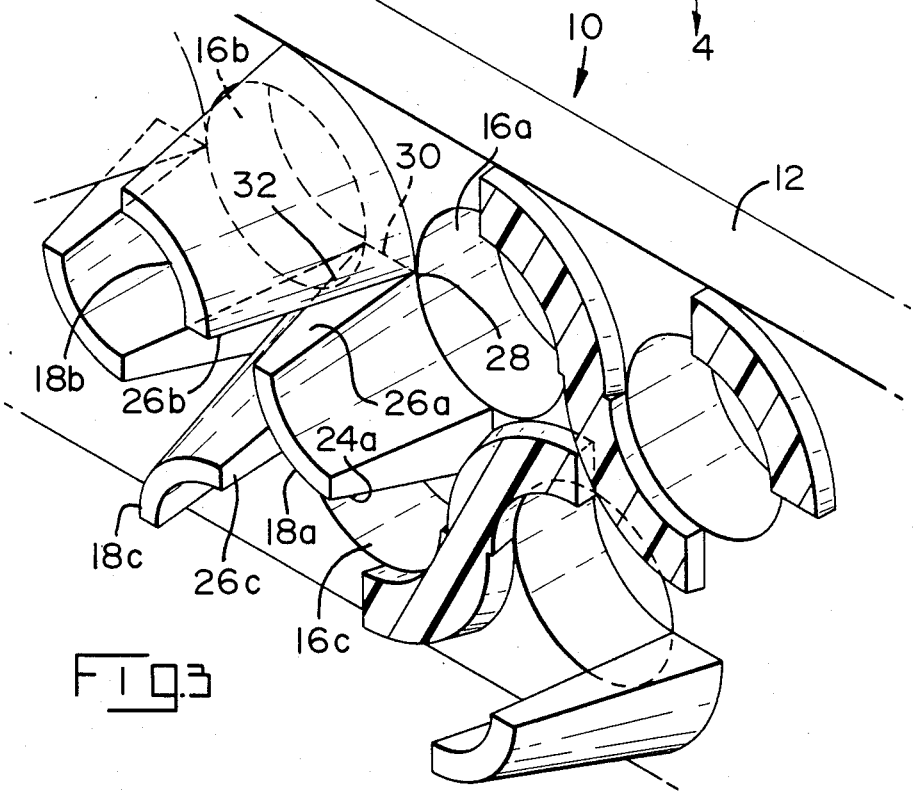
FIG. 3 shows an enlargement of part of the retention wafer of FIG. 1 with some wall sections broken away.

In FIG. 3, wall section **18*a* is associated with hole 16*a* and is disposed at its lower left; wall section 18*b* with hole 16*b*, at its upper right; and wall section 18*c* with hole 16*c*, at its upper left. Side surface 26*a* of wall section 18*a* is preferably in a plane parallel to that of side surface 26*b* of wall section 18*b*, and near the bases thereof side surfaces 26*a* and 26*b* are joined together along a small triangular-shaped joint 32 which extends forwardly from point 30. Such joining adds some strucural strength to retention wafer 10 and does not noticeably interfere with the expanding of the wall sections 18 upon insertion of terminals. A reverse S-shape is formed by the outline of wall sections 18*a* and 18*b*** at their bases.

Wall section **18*c* has a side surface 26*c* which meets outside surface 24*a* of wall section 18*a* at their respective bases in the middle of wall section 18*a*; this does not diminish the utility of either of the wall sections involved. This pattern of each hole 16 in the one row having wall sections disposed on upper right and lower left quadrants, and in the other row having wall sections disposed on lower right and upper left quadrants, is believed to provide the optimum disposition of such wall sections 18 for the densest spacing of terminals in the retention article of the present invention. If the rows of terminals need not be so close together, it is within the scope of the invention that wall sections 18 be disposed about holes 16 in one row without respect to the disposition of wall sections about holes in any other row. It can be seen that more than two rows of terminals can be provided for by having more than two rows of holes 16 in the retention article of the invention. It is also within the scope of the invention that holes 16 not be necessarily located in definite rows at all, so long as wall sections 18** of adjacent holes are sufficiently clear from one another to be expanded individually upon insertion of a terminal.

Figure 4:
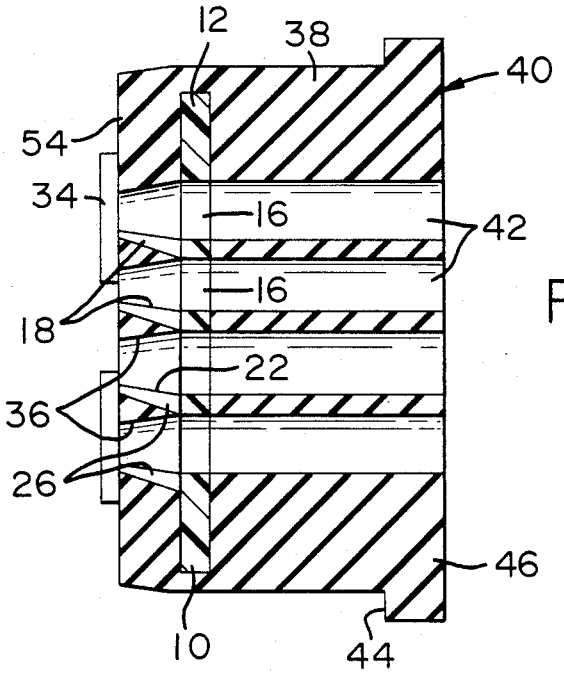
FIG. 4 is a part longitudinal section of the wafer with overmolding.

FIG. 4 shows assembly 40 with elastomeric material 38 overmolded around retention wafer 10, and holes 42 extend from rearward end 46 to forward end 54, through holes 16 of wafer 10. Holes 42 preferably have diameters no larger than the conductors to which terminals 80 are connected, as is discussed hereinbelow.

During the overmolding process core pins (not shown) are located within the mold to create holes 42. Each core pin preferably has a conical head engaging inside surfaces 22 of frustoconical wall sections 18 of each hole 16 of wafer 10, and elastomeric material 38 is molded adjacent to and around the conical heads of the core pins between side surfaces 26 of wall sections 18 forming inner arcuate surfaces 36 which extend between inside surfaces 22 of wall sections 18 to form a continuous frustoconical surface, resulting in the structure of assembly 40 as seen in FIG. 2. Thus a single frustoconical surface is formed around the front end of each hole 16 which includes inside surfaces 22 and inner arcuate surfaces 36. Preferably during the overmolding process a bonding agent is used so that elastomeric material 38 is adhered to plastic wafer 10. Such bonding of materials is especially important between elastomeric material 38 and wafer 10 around the side surfaces 26 and the outside surfaces 24 of wall sections 18 after insertion of terminals 80 into assembly 40 and during later removal thereof, as is discussed hereinbelow.

Figure 5:
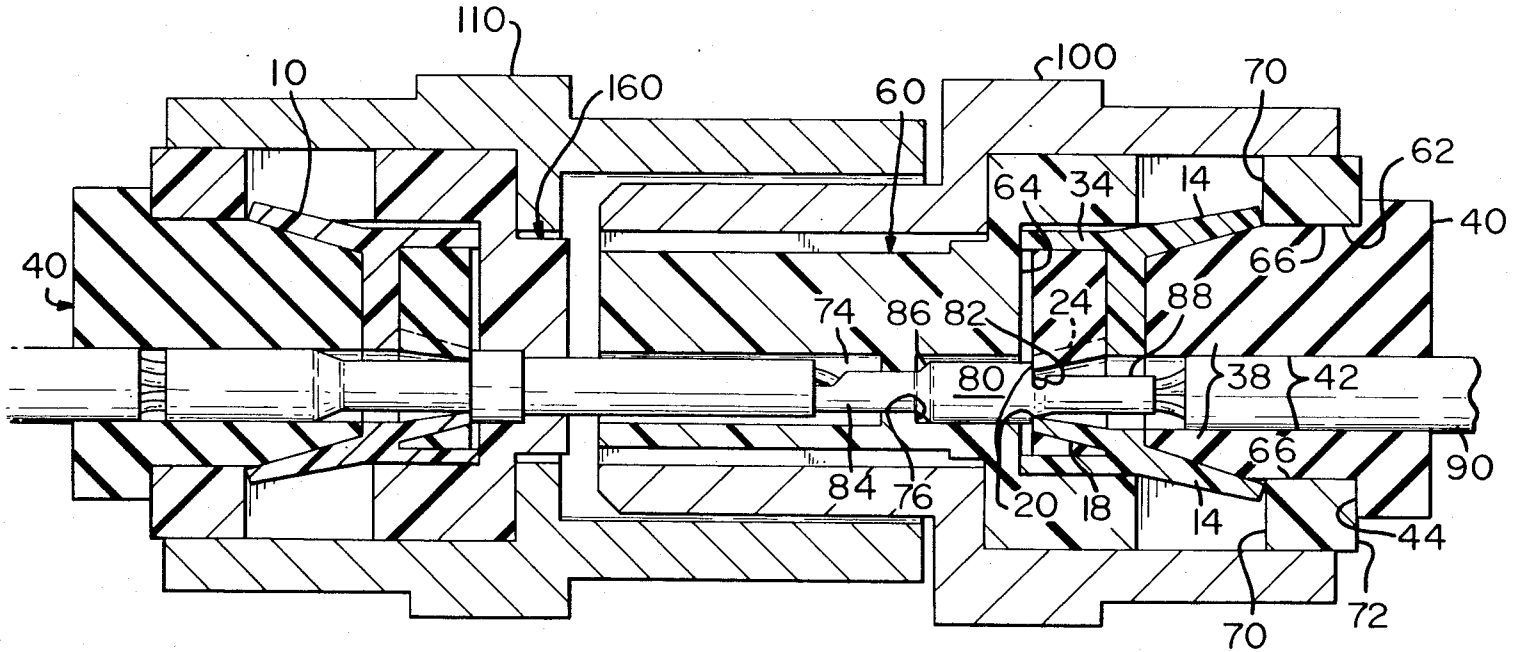
FIG. 5 is a longitudinal section view of the overmolded retention wafer within a connector housing, and a terminal secured therein.
Figure 8:
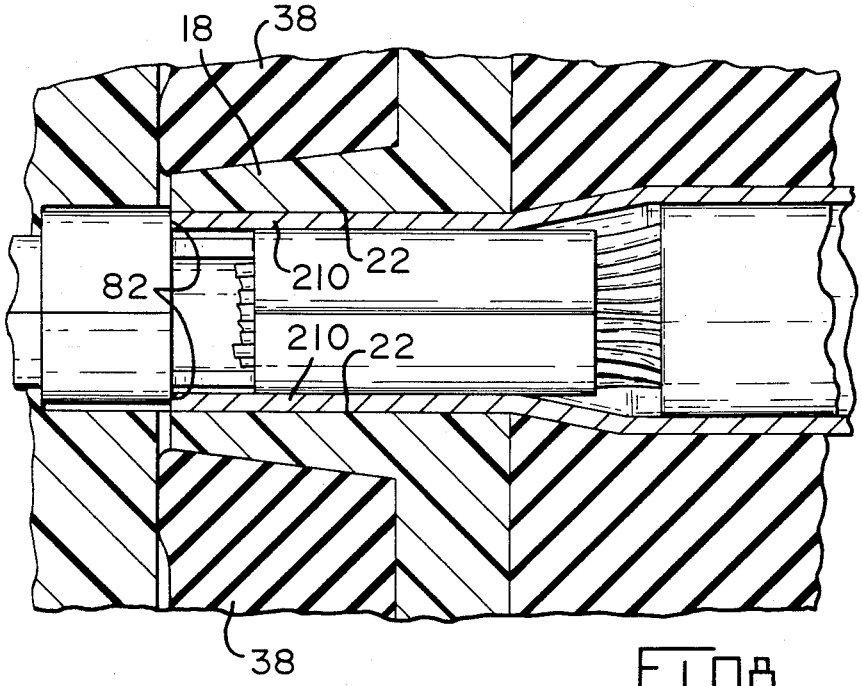
FIG. 8 shows the extraction tool in FIG. 7 after disengaging the wall sections from around the terminal to release it.

As shown in FIG. 5, an assembly 40 is secured within a large rearward cavity 62 of each one of a mating pair of dielectric connector housings 60 (for plug terminals) and 160 (for socket terminals). It is preferred that a small gap be kept between forward end 64 of housing 60 and forward surface 54 of assembly 40 (which includes ends 20 of wall sections 18) to allow for slight localized expansion of forward surface 54 and ends 20 when terminals are inserted (as can be seen in FIG. 8 where the terminal is being removed). Such gap can be assured by projections 34, or by rearward projections from forward cavity end 64, or by projections from sidewalls 66 of cavity 62 as aforesaid. Projections 34 of assembly 40 engage forward end 64 of large cavity 62, forward end 64 acting as a stop surface stopping forward movement of assembly 40.

Each large cavity 62 of housings 60, 160 has sidewalls 6 having recesses 68 therein whereinto retention tines 14 extending from sides of assembly 40 will be disposed upon insertion. During insertion of assembly 40 into housing 60, tines 14 are urged inwardly by sidewalls 66 of large cavity 62 and slide along sidewalls 66 until assembly 40 is fully seated in large cavity 62. Then tines 14 assisted by spring force of adjacent elastomeric material 38, are urged outwardly into recesses 68. An end of each tine 14 engages a forwardly-facing wall 70 of each recess 68 which together act as cooperating stop surfaces. Elastomeric material 38 along the inside surface of each tine 14 gives spring-like support to urge tine 14 outward, while allowing tines 14 to be flexed inwardly during insertion of assembly 40 into large cavity 62 of housing 60. It can be seen that large retention tines 14 allow retention assembly 40 to be self-retaining within housing 60, although adhesive material could be used to assure retention. Ledge 44 of assembly 40 engages rear surface 72 of housing 60, and can be seen to be dimensioned larger than large cavity 62 whereas assembly 40 generally is just slightly smaller than or possibly equal to the inside dimensions of large cavity 62.

Terminal 80 secured in hole 42, 16 is shown with contact section 84 extending forward of assembly 40 and being disposed in terminal-receiving cavity 74 of housing 60 with which hole 42, 16 is aligned, and forward stop shoulder 86 of terminal 80 engages rearwardly-facing stop shoulder 76 of housing 60 to stop forward movement of terminal 80. Conductor-receiving section 88 of terminal 80 has been terminated to a conductor 90, and both conductor-receiving section 88 and an end portion of conductor 90 are secured within assembly 40 with ends 20 of wall sections 18 of wafer 10 engaging rearwardly-facing stop surface of stop shoulder 82 of terminal 80. Mating shells 100, 110 are shown disposed around housings 60, 160 rspectively which are securable together.

During insertion of a terminal 80 into an assembly 40, contact section 84 urges wall sections 18 of hole 42, 16 apart, and likewise urges apart elastomeric material 38 extending between wall sections 18, until stop shoulder 82 passes ends 20 of wall sections 18. Spring-like wall sections 18, assisted by spring force of the surrounding elastomeric material 38, then tend to return to their normal unexpanded condition rearward of stop shoulder 82 and engage terminal 80 with some gripping force therearound. Elastomeric material 38 could be said to act as a tight collar around outside surfaces 24 of wall section 18. If elastomeric material 38 is bonded to wafer 10 especially around wall sections 18 such as by using a bonding agent, the possibility of separation therebetween and resulting problems (especially during later removal of terminals 80) is minimized.

Figure 6:
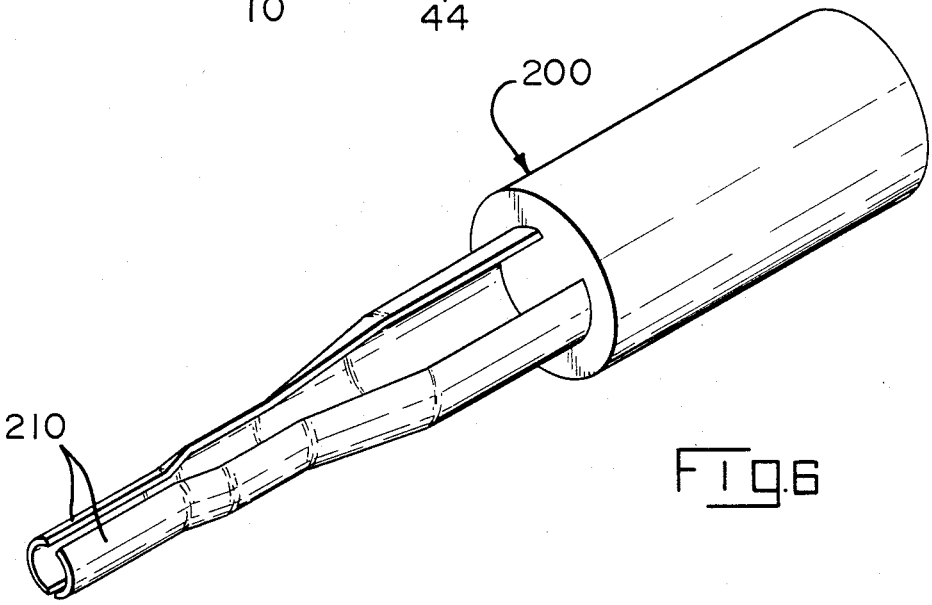
FIG. 6 shows an extraction tool.
Figure 7:
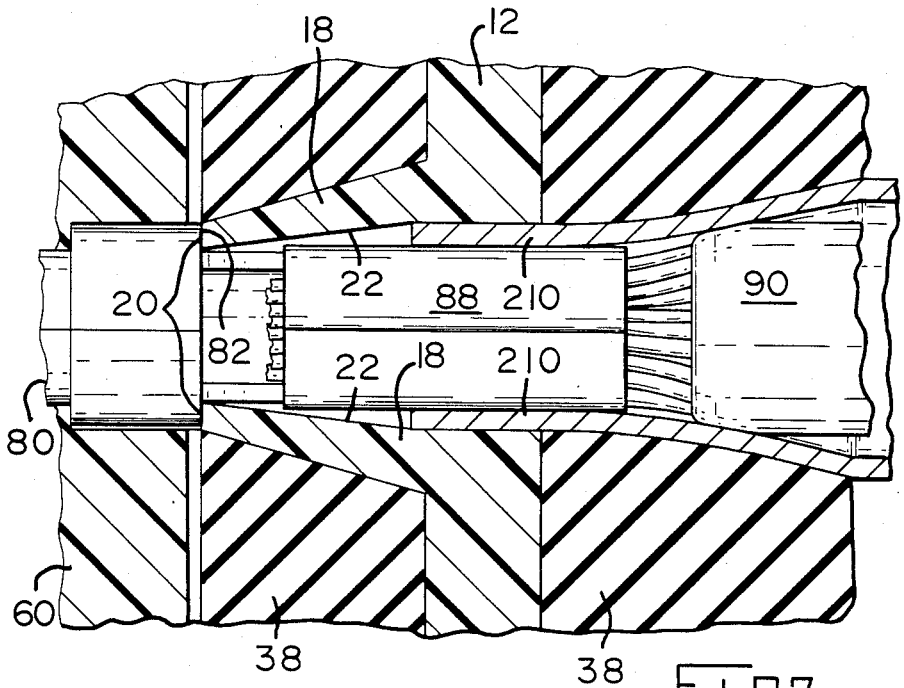
FIG. 7 is a longitudinal section along a retained terminal showing an extraction tool being inserted to extract the terminal from the housing of FIG. 5.

With the present invention it is possible to individually remove and replace terminals 80 which may be done in the following manner, with reference to FIGS. 7 and 8. Extraction tool 200 (illustrated in FIG. 6) is shown in the process of being inserted, first partially as in FIG. 7, then fully as in FIG. 8 from rearward end 46 along a conductor 90 within a hole 42, 16. (FIGS. 7 and 8 are along a terminal 80 retained in assembly 40 within a housing 60 and are taken at a typical angle through opposing wall sections 18). A pair of long, thin arcuate metal arms 210 of tool 200 form nearly a circumferential barrel having an effective diameter just less than that of hole 16 and equal to that of stop shoulder 82 of terminal 80. Arms 210 are designed to be slightly adaptable in diameter. Arms 210 are placed around conductor 90 rearward of connector housing 60 and are manually urged forwardly along conductor 90 entering hole 42 at rearward end 46 of retention assembly 40 slightly urging apart elastomeric material 38. Continuing forward, arms 210 enter through hole 16 of wafer 10 and around terminal 80 eventually engaging inside surfaces 22 of wall sections 18 (and inner arcuate surfaces 36 of elastomeric material 38 between inside surfaces 22), urging them apart. Arms 210 continue forward until reaching and engaging stop shoulder 82.

Terminal 80 may now be removed along with arms 210 of tool 200 by gripping conductor 90 and withdrawing or pulling conductor 90 and tool 200 rearward. To minimize problems resulting from possible snagging of ends 20 by any portion of terminal 80, it is preferable that outside surfaces 24 and side surfaces 26 of wall sections 18 be bonded by a bonding agent to elastomeric material 38 which bonding now acts to prevent wall sections 18 from separating from material 38 and being pulled rearward by terminal 80. A new terminal may now be inserted replacing terminal 80 without having disturbed other terminals or having required disengaging the mating connectors such as is required in some cases for insertion of the extraction tool from the front of the connector, or even worse, having to replace the entire connector because of one terminal needing replacing.

Optionally, ledge 44 may have a forwardly extending ridge (not shown) at its outer periphery to effect a more sealing engagement with rear surface 72 of housing 60.

The present invention may be used for retention of terminals even more closely spaced than 0.050 inch centerlines as in the example given herein. Other thermoplastic and elastomeric materials may be used to form the retention article of the present invention, and while overmolding is the preferred method of forming the retention article of the present invention, other methods may be used such as bonding a premolded elastomeric portion rearward of planar section 12, and either overmolding or bonding a premolded elastomeric portion forward of planar section 12 around wall sections 18. Still other variations may become apparent without departing from the spirit or the scope of the invention or sacrificing its material advantages. The example provided herein is merely a preferred embodiment of the invention.

We claim:

1. An article for retaining electrical terminals within a housing of an electrical connector comprising a stiff wafer-like article of dielectric material with first and second portions of elastomeric material secured thereto;

said article having a plurality of holes extending therethrough for insertion of terminals thereinto to be retainingly secured thereby and said article being securable within a cavity of said housing;

said wafer-like article having a planar section axially normal to said holes, and opposing frustoconical wall sections associated with and extending partially around each said hole;

said wall sections extending forwardly from said planar section and partly converging, and having stop surfaces on ends thereof for engaging a rearwardly-facing stop surface of a stop shoulder of a terminal inserted thereinto;

said first portion of said elastomeric material extending forward from said planar section and surrounding and abutting outside surfaces of said wall sections around said holes to increase the resistance to radial expansion of said wall sections and urge them radially inward against a said terminal inserted thereinto; and said second portion of elastomeric material extending rearwardly from said planar section with said holes extending therethrough to a rearward end of said retention article whereinto said terminals are insertable, said terminals having been terminated to electrical conductors and a portion of each said conductor being secured in said holes in said second portion.

2. An article as set forth in claim 1 wherein said ends of said wall sections have an inner radius less than the radius of an associated said hole.

3. An article as set forth in claim 1 wherein projections extend forwardly from sides of said planar section of said wafer-like article and extend farther forward than said wall sections to engage a rearwardly-facing surface of said connector housing to stop forward movement of said article during insertion of said article in a large rearward cavity of said connector housing.

4. An article as set forth in claim 1 wherein those portions of said holes extending through said second portion of elastomeric material an slightly smaller in diameter than the diameters of said conductors therein, whereby said elastomeric material grips said conductors.

5. An article as set forth in claim 1 wherein said elastomeric material is silicone rubber.

6. An article as set forth in claim 1 wherein said holes are closely spaced.

7. An article as set forth in claim 1 wherein said rearward end of said second portion of elastomeric material has a peripheral ledge therearound to engage a rearward surface of said connector housing.

8. An article as set forth in claim 1 wherein said wall sections each extend around the circumference of an associated said hole an angular distance of from 60° to 120°.

9. An article as set forth in claim 8 wherein said wall sections extend an angular distance of approximately 90°.

10. An article as set forth in claim 1 wherein a side surface of one said wall section around a first said hole is adjacent a side surface of another said wall section around a second hole adjacent said first hole, proximate said planar section.

11. An article as set forth in claim 10 wherein said side surface of said one wall section and said side surface of said another wall section are coplanar.

12. An article as set forth in claim 1 wherein said first portion of elastomeric material engages side surfaces of said wall sections associated with each said hole and extends between said side surfaces arcuately around said hole, forming along with inside surfaces of said wall sections a single frustoconical surface at a forward end of said hole.

13. An article as set forth in claim 12 wherein said first portion of elastomeric material is bonded to said outside surfaces and said side surfaces of said wall sections.

14. An article as set forth in claim 1 wherein said elastomeric material is overmolded around said wafer-like article to form said first and said second portions.

15. An article as set forth in claim 14 wherein said elastomeric material is bonded to said wafer-like article.

16. An article as set forth in claim 1 wherein large retention tines extend rearwardly from sides of said planar section of said wafer-like article and extend slightly outwardly such that end surfaces thereof engage respective forwardly-facing stop surfaces in said connector housing, and said second portion of elastomeric material engages inside surfaces of said large retention tines.

17. An article as set forth in claim 16 wherein said article is self-retaining in said housing.

18. An article as set forth in claim 1 wherein said wafer-like article is molded from thermoplastic material.

19. An article as set forth in claim 18 wherein said thermoplastic material is polyetherimide resin.

20. A connector housing assembly for electrical terminals terminated to electrical conductors comprising a dielectric connector housing and a retention article secured within said housing;

said housing having a large cavity in a rearward section thereof wherein said retention article is secured;

said retention article having a plurality of holes extending forwardly from a rearward end thereof, said holes aligned with and communicating with terminal-receiving passageways in a forward section of said housing whereinto said terminals may be retainingly inserted;

said retention article having a stiff wafer-like article of dielectric material, a first portion of elastomeric material secured forwardly thereof and a second portion of elastomeric material secured rearwardly thereof;

said wafer-like article having a planar section axially normal to said holes and opposing frustoconical wall sections associated with and extending partially around each said hole;

said wall sections extending forwardly from said planar section and partly converge, and having stop surfaces on ends thereof for engaging a rearwardly-facing stop surface of a stop shoulder of a terminal inserted thereinto; and said first portion of elastomeric material extending forward from said planar section surrounding and abutting outside surfaces of said wall sections around said holes to increase the resistance to radial expansion of said wall sections and urge them radially inward against a said terminal inserted thereinto.

21. An assembly as set forth in claim 20 wherein said wall sections extend an angular distance of about 90° around the circumference of an associated said hole.

22. An assembly as set forth in claim 20 wherein said ends of said wall sections have an inner radius less than the radius of an associated said hole.

23. An assembly as set forth in claim 20 wherein said first portion of elastomeric material engages side surfaces of said wall sections associated with each said hole and extends between said side surfaces arcuately around said hole, forming along with inside surfaces of said wall sections a single frustoconical surface at a forward end of said hole, and said first portion of elastomeric material is bonded to said outside surfaces and said side surfaces of said wall sections.

24. An assembly as set forth in claim 20 wherein said first and second portions of elastomeric material are bonded to said wafer-like article.

25. As assembly as set forth in claim 20 wherein said elastomeric material is overmolded around and bonded to said wafer-like article.

26. An assembly as set forth in claim 20 wherein a gap separates a forward surface of said retention article and forward ends of said wall sections from a rearwardly facing surface of said housing within said large cavity.

27. An assembly as set forth in claim 20 wherein projections extend forwardly from sides of said planar section of said wafer-like article and extend farther forward than said wall sections to engage a rearwardly facing surface of said housing within said large cavity to space said article from said rearwardly facing surface.

28. An assembly as set forth in claim 20 wherein said connector housing includes means to engage said planar section of said wafer-like article whereby said retention article is spaced from a rearwardly facing surface of said housing within said large cavity.

29. An assembly as set forth in claim 20 wherein said wafer-like article is molded from polyetherimide resin and said elastomeric material is silicone rubber.

30. An assembly as set forth in claim 20 wherein said holes are closely spaced.

31. An assembly as set forth in claim 20 wherein said retention article is secured within said housing prior to insertion of said terminals thereinto.

32. An assembly as set forth in claim 20 wherein said retention article is secured within said housing after said terminals have been secured in said retention article.

33. An assembly as set forth in claim 20 wherein said rearward end of said retention article has a peripheral ledge therearound of elastomeric material to engage a rearward surface of said housing.

34. An assembly as set forth in claim 20 wherein those portions of said holes extending through said second portion of elastomeric material of said retention article are slightly smaller in diameter than the diameters of said conductors therein which conductors are terminated to said terminals having been inserted into said assembly, whereby said elastomeric material grips said conductors.

35. An assembly as set forth in claim 20 wherein an extraction tool may be inserted into a said hole from said rearward end around a said conductor such that forward arcuate arm sections of said tool are extendable forwardly around an associated said terminal to engage and urge apart associated said wall sections retaining said terminal, thereby releasing said terminal for rearward removal from said assembly.

36. An assembly as set forth in claim 20 wherein a side surface of one said wall section around a first said hole is adjacent a side surface of another said wall section around a second hole adjacent said first hole, proximate said planar section.

37. An assembly as set forth in claim 36 wherein said side surface of said one wall section and said side surface of said another wall section are coplanar.

38. An assembly as set forth in claim 20 wherein large retention tines extend rearwardly from sides of said planar section of said wafer-like article and extend slightly outwardly such that end surfaces thereof engage respective forwardly-facing stop surfaces along sides of said large cavity of said housing, and said second portion of elastomeric material engages inside surfaces of said large retention tines.

39. An assembly as set forth in claim 38 wherein said retention article is self-retaining in said housing.

40. A method of forming a retention article securable in a connector housing for retaining electrical terminals therein comprising the steps of:

forming a wafer-like article of thermoplastic material, said article having a planar section having holes therethrough and opposing wall sections associated with and extending partially around each said hole, said wall sections extending forwardly from said planar section and partly converging at forwardly-facing end surfaces thereof; and overmolding said wafer-like article with elastomeric material, thus forming a first portion of elastomeric material forwardly of said planar section such that said first portion surrounds and abuts outside surfaces of said wall sections around said holes, and a second portion of elastomeric material rearwardly of said planar section such that said second portion has holes extending therethrough aligned with said holes in said planar section.

41. A method as set forth in claim 40 further including the step of placing a bonding agent on surfaces of said wafer-like article whereto said elastomeric material is to be molded, thus bonding said first and said second portions to said wafer-like article.

42. A method as set forth in claim 41 wherein said overmolding is performed by including inserting into a mold said wafer-like article and a plurality of core pins each having a conical head disposed adjacent inside surfaces of said wall sections associated with each said hole of said wafer-like article, and molding said elastomeric material around said wafer-like article and said core pins, forming said retention article such that the forward end of each said hole has a single frustoconical surface.

* * * * *